United States Patent [19]

Hassenauer

[11] 4,200,208

[45] Apr. 29, 1980

[54] PNEUMATIC HOPPER GATE

[75] Inventor: Robert L. Hassenauer, Wilmette, Ill.

[73] Assignee: Evans Products Company, Portland, Oreg.

[21] Appl. No.: 900,132

[22] Filed: Apr. 26, 1978

[51] Int. Cl.[2] ..... B65G 65/62; B65G 65/66

[52] U.S. Cl. ..... 222/505; 222/556

[58] Field of Search ..... 222/505, 556, 559, 560, 222/544, 515

[56] References Cited

U.S. PATENT DOCUMENTS

| | | | |
|---|---|---|---|
| 1,164,195 | 12/1915 | Kendall | 222/505 |
| 1,760,094 | 5/1930 | Tolman | 222/556 X |
| 2,718,986 | 9/1955 | Peoples | 222/556 X |
| 4,023,719 | 5/1977 | Noyon | 222/556 X |

*Primary Examiner*—Robert J. Spar
*Assistant Examiner*—Frederick R. Handren
*Attorney, Agent, or Firm*—F. Travers Burgess

[57] ABSTRACT

An outlet gate arrangement for a hopper having sloping side walls converging toward each other and defining between their lower edges a discharge opening communicating with a pneumatic discharge tube comprises a gate having an upper surface abuttingly engageable with the lower edges of the side walls, a gate operating mechanism having a part movable transversely of the discharge opening, the gate being pivotally connected to the transversely movable part such that, upon movement of the transversely movable part and the gate from a closed position, a portion of the gate slidably follows the bottom surface of one of the side walls permitting the gate to pivot about its pivotal connection to the transversely movable part and thereby move the gate out of sealing engagement with the lower edge of the other side wall and away therefrom to permit discharge of lading through the discharge opening. The operating mechanism includes a manually actuated linkage for moving the transversely movable part between gate open and gate closed position.

8 Claims, 7 Drawing Figures

PNEUMATIC HOPPER GATE

BACKGROUND OF THE INVENTION

1. Field of the Invention

The invention relates to outlet gate arrangements for hoppers and particularly to those of pneumatic discharge systems utilized on railway hopper cars.

2. The Prior Art

The prior art discloses pneumatic discharge systems for hoppers having a tubular element at the bottom thereof open at the top for communication with the hoppers and arranged for connection at its opposite ends to a pneumatic conveyor system and the closures have consisted of tubes rotatably mounted within the tubular element and formed with elongated or helical slots registrable with the discharge opening from the hopper into the tubular outlet. Examples of the tubular closure type of pneumatic hopper outlet appear in McCausland et al U.S. Pat. No. 3,067,774, Koranda U.S. Pat. No. 3,583,768 and Mundinger et al U.S. Pat. No. 3,675,975. The prior art also discloses pneumatic hopper outlets utilizing gate members slidable transversely of the hopper discharge opening, as exemplified in Adler U.S. Pat. No. 3,637,262, Schuller U.S. Pat. No. 3,693,846 and Shaver et al U.S. Pat. Nos. 3,693,839 and 3,700,143.

SUMMARY OF THE INVENTION

The invention provides more accurate control of the flow of material from the hopper into the pneumatic outlet tube by the use of a gate or closure member which is not only movable horizontally with respect to the discharge opening but also rotates to permit a greater area of the discharge opening to be exposed responsive to small translational movements of the gate or closure member. Because the gate is entirely separate from the pneumatic discharge tube and from the hopper structure, it can be disassembled without removing the entire discharge system from the railway car. The operating mechanism is simple, requiring no lubrication or maintenance and has no gears as provided in other devices of the prior art which could bind upon being clogged with foreign matter picked up during railway operation.

DETAILED DESCRIPTION OF THE INVENTION

Figure 1:
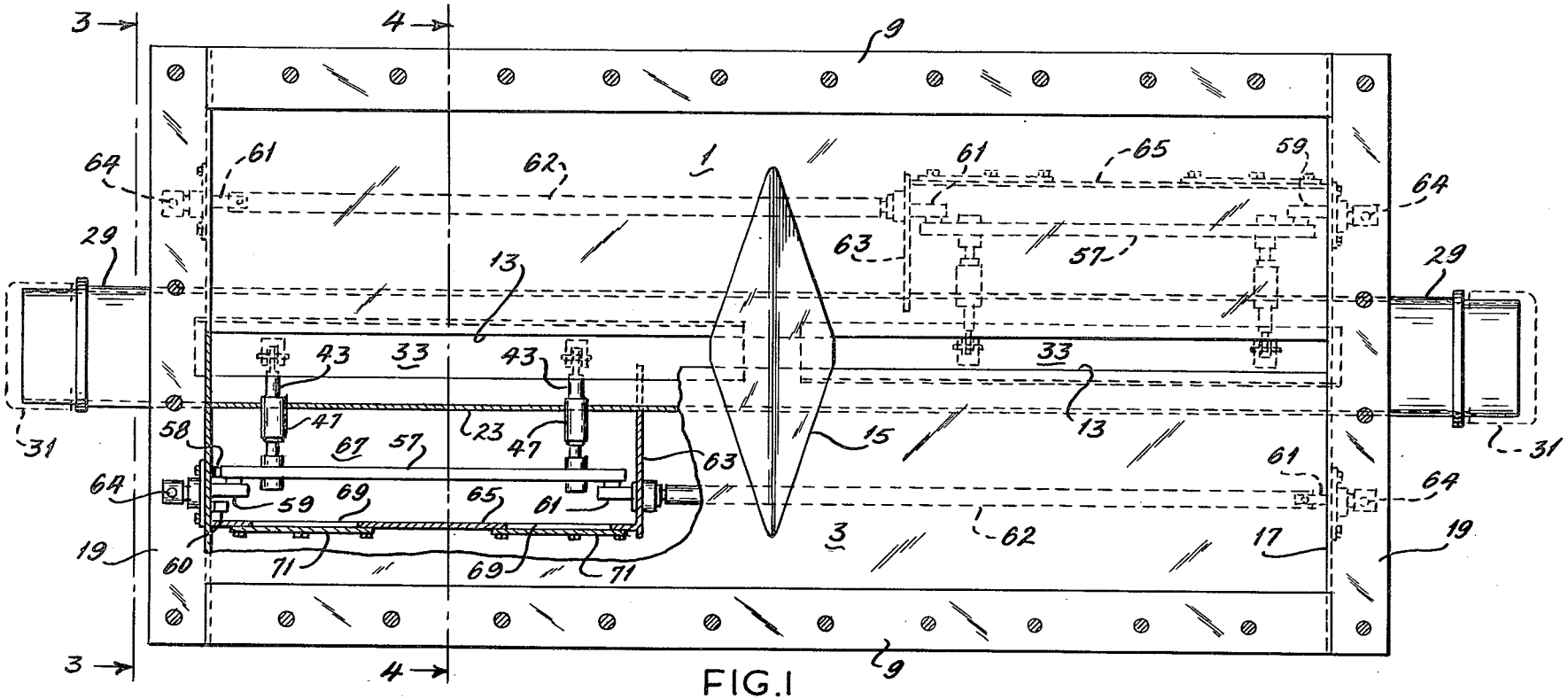
FIG. 1 is a plan view partially in section of a hopper discharge arrangement incorporating the invention.
Figure 2:
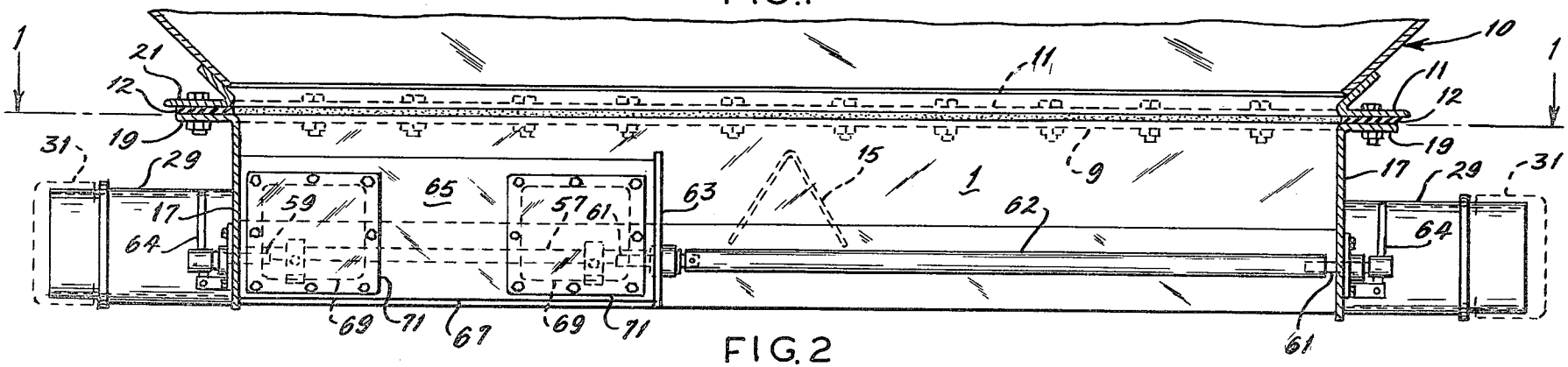
FIG. 2 is a side elevational view of the structure shown in FIG. 1.

The hopper discharge assembly has a pair of sloping side walls 1 and 3, the lower edges 5 and 7 of which are spaced apart transversely to define a discharge opening, the upper margins 9 of both side walls 1 and 3 forming horizontal flanges for attachment to the bottom flanges 11 on the hopper 10 of a railway hopper car, an elastomeric gasket 12 being interposed between flanges 9 and 11 to form a seal between hopper 10 and the discharge assembly. The discharge assembly has a pair of longitudinally aligned discharge openings 13, 13 spaced apart longitudinally from each other and separated by divider wall structure 15, and bounded at their ends by vertical end walls 17 flanged at 19 along their upper margins for attachment to flanges 21 of the railway car hoppers, sealing gasket 12 also being interposed between flanges 19 and 21. Below discharge openings 13 a tubular trough 23 extends longitudinally of the assembly with its upper edges sealingly secured at 25 to the bottom surfaces of sloping side walls 1 and 3 and with its semicylindrical lower portion 27 extending longitudinally outwardly of and through end walls 17 to form the lower part of cylindrical pneumatic discharge conduits 29, the end portions of which are arranged to receive caps 31.

For closing discharge openings 13, a gate member consisting of an elongated plate generally indicated at 33 is formed with depending clevis-like brackets 35 on its lower surface, each having a pivot hole 37 offset to one side of the center line of the opening and an I-bolt 39 is connected to clevis-like brackets 35 by a pin 41, I-bolts 39 being threadably received in a horizontal transversely extending internally threaded hollow rod 43 which, in turn, is slidably received in a sleeve bearing 45 mounted in a tube 47 projecting from one side of tubular trough 23.

Figure 4:
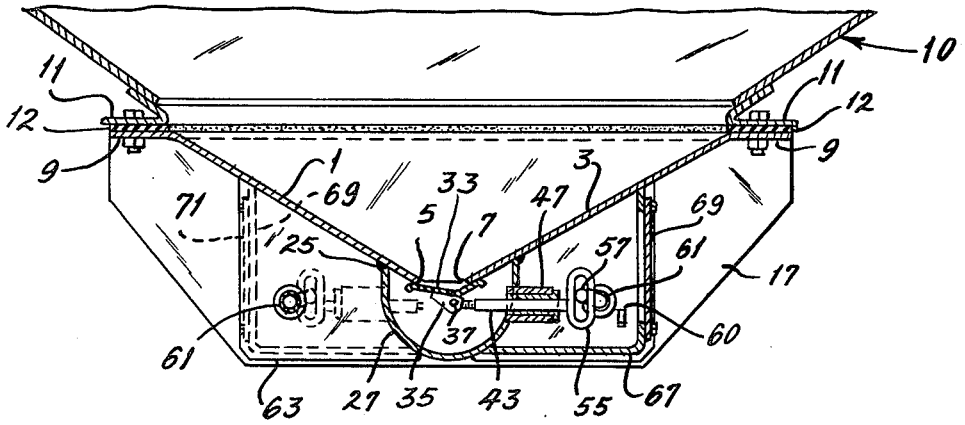
FIGS. 4 and 5 are transverse vertical sectional views taken along line 4—4 of FIG. 1.
Figure 5:
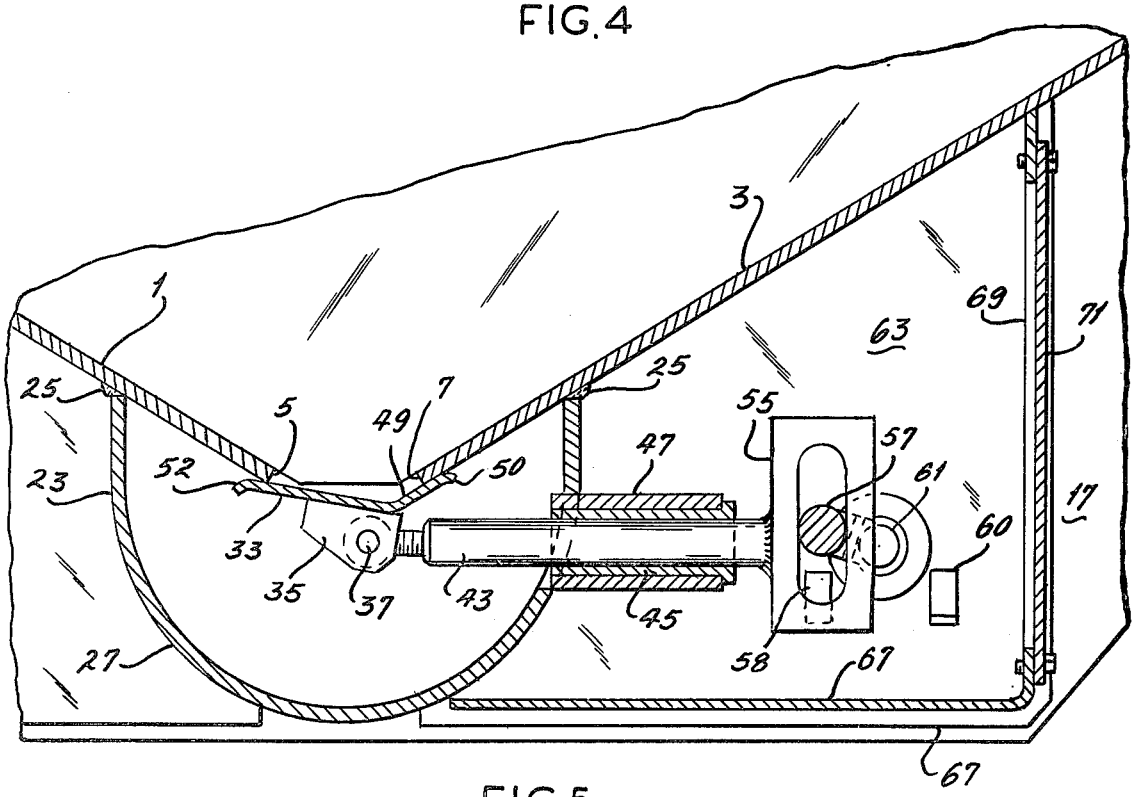

Plate 33, which forms the gate member, is of oblique angular cross section having a short leg 49 normally in abutting engagement with the lower surface of sloping side wall 3 and a long leg 51 engaging the lower corner of bottom edge 5 of the other sloping side wall 1, the intersection of legs 49 and 51 being close to the pivot point 37 of the gate member 33 on I-bolt 39 such that when transversely movable rod 43 is translated to its closest position toward the center of the discharge openings 13, the gate will be in the fully closed position. Gate 33 is also formed with downwardly bent longitudinal margins 50 and 52 so that as rod 43 is translated transversely away from the center line of the opening, gravity will cause plate 33 to rotate in a counterclockwise direction, as seen in FIGS. 3–5, as the plate moves transversely and downwardly bent margin 50 of plate 33 follows the upwardly sloping bottom surface of side wall 3 to selected positions exemplified in FIGS. 6 and 7.

Figure 3:
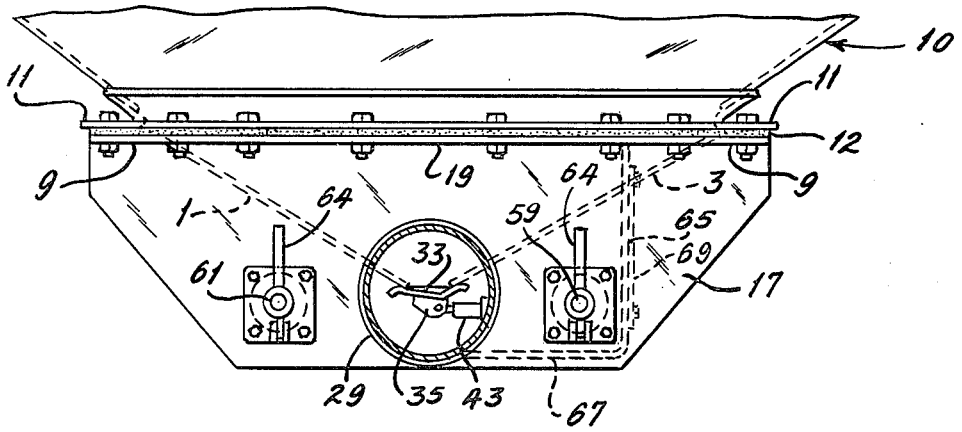
FIG. 3 is an end elevational view of the structure shown in FIGS. 1 and 2.
Figure 6:
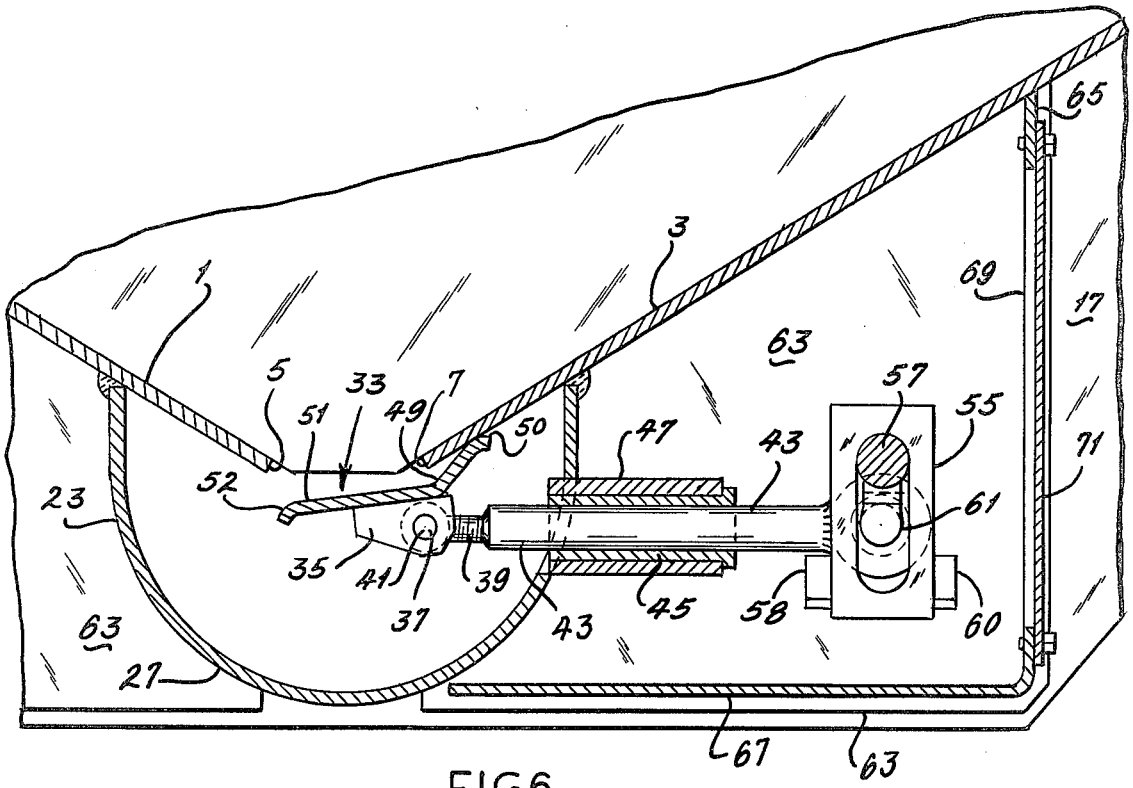
FIGS. 6 and 7 are transverse vertical sectional views corresponding to FIG. 5 but showing the valve in two different open positions.
Figure 7:
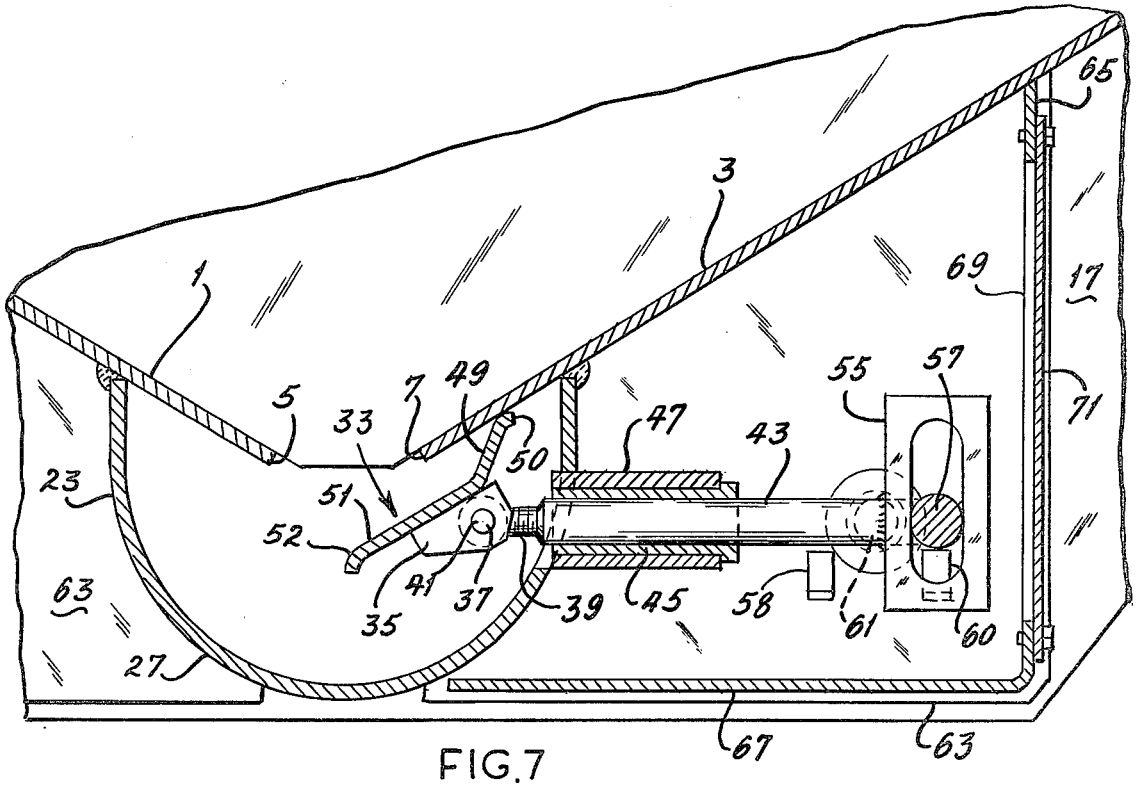

For selectively moving each gate plate 33 from the closed position of FIG. 3 to the open positions of FIGS. 6 and 7, the operating mechanism comprises a scotch yoke in the form of a slotted crosshead member 55 welded to the end of each rod 43 remote from the connection of the rods to the gate and slidably receives between its legs a crank in the form of eccentric rod 57 secured at its opposite ends to axially aligned manually actuated shafts 59 and 61, which, in turn, are rotatably journaled respectively in end walls 17 of the assembly, and in end walls 63 of the operating mechanism housings and the remote end walls 17 of the assembly. Each shaft 61 includes a tubular intermediate section 62. Handles 64 are secured to the ends of shafts 59 or 61 protruding from end walls 17 so that upon manual rotation of the handles, rods 57 will move circumferentially about the aligned axes of shafts 59 or 61, acting through scotch yoke slotted members 55 to translate rods 43 away from the center line of the hopper to close gates 33. It will be evident that with the extensions of each operating shaft formed by tube 62, both gates can be opened from either side of the car.

Each operating mechanism housing is formed by an end wall 17 of the outlet assembly, the aforementioned housing end wall 63 spaced longitudinally inwardly from the respective end walls 17, the respective sloping side walls 1 and 3, a vertical outer side wall 65 and a bottom wall 67. For easy access to the operating mechanism, side walls 65 are formed with apertures 69 closed by removable cover plates 71.

For limiting movement of the cranks 57, 59, 61 to the fully closed and fully open positions respectively, a pair of transversely spaced stop lugs 58 and 60 are mounted on the inner surface of the assembly end walls 17 and mechanism housing end walls 63 on opposite sides of the respective shafts 59 and 61 for underlying engagement with offset rods 57 in their extreme closed and open positions.

Operation of the discharge assembly is as follows: While a railway car to which the assembly is applied is in transit, both gates 33 are in the closed position seen in FIGS. 3–5 in which the upper surfaces of the gates abut the lower edge 5 or 7 of the respective sloping side walls 1 or 3 and the lower marginal portion of the respective sloping side wall 3 or 1 adjacent edge 7 or 5. Upon reaching its destination the end caps 31 are removed from the ends of discharge tubes 29, one of which is connected to a suitable suction conveyor conduit, the other tube 29 being left open to permit the entrance of air during the application of suction. One or both of the handles 64 at either side may then be rotated from the closed position shown in FIGS. 4 and 5 to the full open position shown in FIG. 7 or any number of intermediate positions such as that illustrated in FIG. 6. Both gates may be operated from either side of the car because of the extended operating shafts formed by shafts 61 and tubes 62. Because each of the gates 33, 33 may be actuated independently of the other and each may be opened to any number of intermediate positions as well as the full opened position, precise control for unloading is provided to permit material in the hopper to be unloaded into the discharge trough 23 gradually or in carefully metered quantities as needed to accomplish fast and effective unloading of the hopper. Preferably the gate 33, remote from the end of the tube 29 to which suction is applied, should be opened first and most of the material in the hopper, i.e., about 90%, will pass through the open gate. When material stops flowing through the remote gate the operator closes the remote gate and opens the adjacent gate, by rotating the handle 64, to complete the unloading operation. Unlike most prior art devices, in which the gate is movable solely transversely of the opening, the gate constructed according to the invention rotates downwardly from the opening as it moves transversely away from closed position, thus exposing a much greater area of the outlet in proportion to the magnitude of the transverse movement of the operating mechanism than in the prior art constructions, in which the gate or valve is movable only transversely of the outlet opening. Upon completion of the unloading operation, the gates can be closed by simply reversing the direction of rotation of handles 64.

The details of the hopper outlet gate arrangement described herein may be varied substantially without departing from the spirit of the invention and the exclusive use of such modifications as come within the scope of the appended claims is contemplated.

I claim:

1. An outlet gate arrangement for a hopper having sloping side walls converging toward each other and spaced apart at their lower edges to define a discharge opening, a gate having an upper surface sealingly engageable with said side walls adjacent their opening-defining lower edges when said gate is closed, means maintaining said gate in constant engagement with the bottom surface of one of said side walls, a gate operating mechanism having a part movable transversely of said opening, a pivotal connection between said gate and said transversely movable part, said pivotal connection having its axis parallel to and spaced from the lower edges of said side walls and forming the sole support of said gate whereby when said pivotal connection is moved transversely from its gate-closing position, a marginal portion of the upper surface of said gate slidably follows the bottom surface of said one sloping side wall and said gate rotates about said pivotal connection away from the lower edge of the other sloping side wall and simultaneously moves transversely away therefrom to permit the discharge of lading through said opening.

2. An outlet gate arrangement according to claim 1, wherein said maintaining means comprises gate structure in which the pivotal connection of said gate to said transversely movable part is closer to the side of said gate engaging said one side wall than to that engaging said other side wall whereby to provide gravitational rotation of said gate away from the lower edge of said other side wall when said transversely movable part is moved transversely away from said opening.

3. An outlet gate arrangement according to claim 2, wherein said gate is of shallow angulated cross section, the apex of which is in the region of the pivotal connection of said gate to said transversely movable part.

4. An outlet gate arrangement according to claim 3, wherein the apex of said gate is closer to said one sloping side wall lower edge than to the other sloping side wall lower edge.

5. An outlet gate arrangement according to claim 4, wherein the longitudinal margins of said gate are curved downwardly.

6. An outlet gate arrangement according to claim 5, wherein said operating mechanism comprises a longitudinally extending cranked shaft, said transversely movable part having an operative connection to a crank on said shaft whereby upon rotation of said shaft said transversely movable part is moved from gate closed to gate open position.

7. An outlet gate arrangement according to claim 6, wherein said transversely movable part mounts a scotch yoke engageable with a crank on said shaft whereby to produce transverse reciprocation of said transversely movable part upon rotation of said shaft.

8. An outlet gate arrangement according to claim 7, wherein said scotch yoke is a slotted member affixed to the end of said transversely movable part remote from said gate.

* * * * *